United States Patent [19]

Dente et al.

[11] Patent Number: 4,533,459

[45] Date of Patent: Aug. 6, 1985

[54] EXTRACTION PROCESS

[75] Inventors: Mario Dente, Milan, Italy; Guiliano Porcari, Edmonton, Canada; Lee F. Robinson, London, England

[73] Assignee: RTR Riotinto Til Holding S.A., Zug, Switzerland

[21] Appl. No.: 642,383

[22] Filed: Aug. 20, 1984

Related U.S. Application Data

[63] Continuation of Ser. No. 299,306, Sep. 4, 1981, abandoned.

[30] Foreign Application Priority Data

Sep. 17, 1980 [IT] Italy ..... 68438 A/80

[51] Int. Cl.[3] ..... C10G 1/04

[52] U.S. Cl. ..... 208/11 LE

[56] References Cited

U.S. PATENT DOCUMENTS

| | | | |
|---|---|---|---|
| 3,969,220 | 7/1976 | Anderson et al. | 208/11 LE |
| 4,225,433 | 9/1980 | Liu et al. | 208/11 LE |
| 4,396,498 | 8/1983 | Dente et al. | 208/11 LE |
| 4,402,552 | 9/1983 | Baas et al. | 208/11 LE |

*Primary Examiner*—D. E. Gantz

*Assistant Examiner*—A. Pal

*Attorney, Agent, or Firm*—Lee, Smith & Zickert

[57] ABSTRACT

In the extraction of bitumen oils from oil sands, the raw material is first slurried with a stream of hot water under conditions promoting the release of the bitumen oils without disintegration of clay in the raw material; the water to raw material is at least 1:1 by weight. The slurry is separated into an oil-rich component, a solids component, and a middlings component containing essentially water and fines with only minor proportions of oil and solids. The middlings component, after removal of the contained fines and the solids is recycled as a part of the slurrying water.

12 Claims, 6 Drawing Figures

EXTRACTION PROCESS

This application is a continuation of application Ser. No. 299,306, filed Sept. 4, 1981, and now abandoned.

This invention relates to the extraction of bitumen oils from a raw material consisting essentially of mined oil sands but also containing included clay and other foreign matter.

Oil sands vary in constitution according to the area in which they are found, but those mined in Alberta, Canada for example are in the form of particles each consisting of a nucleus of sand and fines which is wetted by a layer of connate water containing fines. The water layer is in turn enclosed by a layer of a mixture of oils, referred to herein as "bitumen oils". The oil sands as mined further includes clay usually as large lumps.

The only process in commercial use for the extraction of bitumen oil from oil sands is that known as the "Hot water process". The mined oil sands, including clay, is treated with hot water and steam in a digester which mechanically disintegrates the oil sands vigorously and with them the clay.

The resulting pulp passes to a separation vessel where the sand settles out and is withdrawn as sand tailings. The dissolved bitumen oils float upwards, forming a coherent mass known as froth, and is recovered by skimming in the separation vessel. A third, aqueous, stream called middlings is withdrawn separately and sent to a scavenging unit which usually entails air floatation in order to recover suspended bitumen oils.

Because of the presence in the middlings stream of large quantities of fines, due largely to the disintegration of the clay, and the inclusion of minor proportions of residual oil and chemical compounds which tend to hold the fines in suspension, the separation of the bitumen oils from the middlings stream in the scavenging unit can only be effected with great difficulty, and under very carefully controlled conditions. In addition, the presence of settling solids further hinders the separation of the bitumen oils.

In the present invention, it is proposed to subject the raw material to conditioning with a high water to solid dilution, in order to promote the separation of the oil sands without the need for severe mechanical action and therefore without substantial disintegration of the clay, and to recycle the aqueous middlings to the conditioning unit after removal of at least a part of the solids. By so doing, the creation of fines in the process is minimised, thus alleviating the problem of fines removal, and the energy requirements of the process are reduced compared with those needed in the Hot Water Process.

Thus, one aspect of the present invention resides in a process for extracting bitumen oils from a raw material consisting essentially of oil sands, the process including the steps of (a) conditioning the raw material with a stream of hot water to form an aqueous slurry, with a water to raw material ratio of at least 1:1 by weight and under conditions promoting the release of bitumen oils from the raw material without substantial disintegration of clay present in the raw material;

(b) separating the slurry into an oil-rich component, a solids components and a middlings component containing essentially water and fines with only minor proportions of oil and solids; and (c) recycling the middlings component, after removal of at least a part of the fines and solids, and using that component as at least a part of the water supplied for the conditioning step. Preferably the water to raw material ratio is between 1.5:1 and 3:1 by weight and the temperature of the hot water is at least 70° C. and is preferably about 90° C.

Because of (1) the gentleness of the conditioning treatment, (2) the consequential minimising of the production of fines from the disintegration of the clay accompanying the tar sands, and (3) the relative large quantities of hot water employed to release the bitumen oils without vigorous agitation, it is possible to treat mined mineral having a tar sands content lying within a wide range. In particular it is possible by the process to treat low grade tar sands containing relatively large quantities of clay; previous to the present invention, the violent agitation in the conditioning unit has given rise to the disintegration of large amounts of clay and their dispersion in the process water. This causes an unnecessarily high apparent viscosity of the process water which hinders the separation of the bitumen oils. In the present invention, due both to the reduced amount of dispersed clay and to the higher dilution this negative effect is greatly reduced.

The use of a relatively large hot water to solids ratio in the conditioning step of the invention is made possible by recycling the hot water which markedly reduces the energy demands.

It is found that the gentleness of the conditioning treatment gives rise to a degree of separation of the oil sands into its components before discharge from the conditioning unit, thus simplifying subsequent separation and the equipment therefor. It is preferred to direct the liquids of the separated discharge first to an oil/water separator, and then to remove the solids from the aqueous component withdrawn from that separator; the oil/water separator may incorporate air floatation to improve the separation of the bitumen oils from the water. As the aqueous components then contain little oil, the task of clarifying the water for recycle is eased; removal of solids from the aqueous component preferably includes flocculation, in which the low level of contained oil reduces the amount of flocculant required.

A second aspect of the invention may then consist of a process for extracting bitumen oils from a raw material consisting essentially of oil sands, the process including the steps of:

(a) conditioning the raw material in a conditioning drum with a stream of hot water to form an aqueous slurry, with a water to raw materials ratio of at least 1:1 by weight and under conditions promoting the release of bitumen oils from the raw material without substantial disintegration of clay present in the material;

(b) separating the conditioned aqueous slurry into an oil-rich component, formed essentially of bitumen oils and water, and a solids component consisting of solids with only minor proportions of bitumen oils and water;

(c) directing the oil-rich component to a first separation vessel;

(d) effecting in the first vessel separation between the bitumen oils and the water;

(e) applying the water from the first separation vessel to dilute the solids component and passing the diluted solids component to a second separation vessel;

(f) removing from the second separation vessel a stream consisting predominantly of solids and a stream consisting predominantly of water; and (g) recycling the water stream as at least a part of the water supplied for the conditioning step.

In this way a more efficient separation of the bituminous froth from the associated aqueous phase is achieved in the first vessel due to the low concentration of clays in the process water and due to the very limited amount of coarse solids present.

The separated process water is then recovered from this vessel along with any associated fines and is sent to redilute the separated solids stream from the conditioning drum, prior to being sent into the second separation vessel. This reduces the bitumen oils losses in the reject sand due to the low clays concentration and the low bitumen oils concentration in the aqueous phase present in the second separation vessel.

The process water and solids are separated in this second separation vessel, some or all of the process water preferably being treated by flocculation and subsequent clarification before being recombined, with that portion of process water that was not clarified, back to the process. The solid phase is removed from the second separation vessel as a water saturated solid.

The amount of process water which will require treatment is a function to the fines content of the oil sands being processed. However, since all the process water is recycled this eliminates the requirement for a tailings ponds and the energy requirements of the process are reduced compared with those needed in the Hot Water Process.

The invention will be more readily understood by way of example from the following description of a process for extracting bitumen oils from oil sands, reference being made to the accompanying drawings, in which

SHORT DESCRIPTION OF THE DRAWINGS

Figure 1:
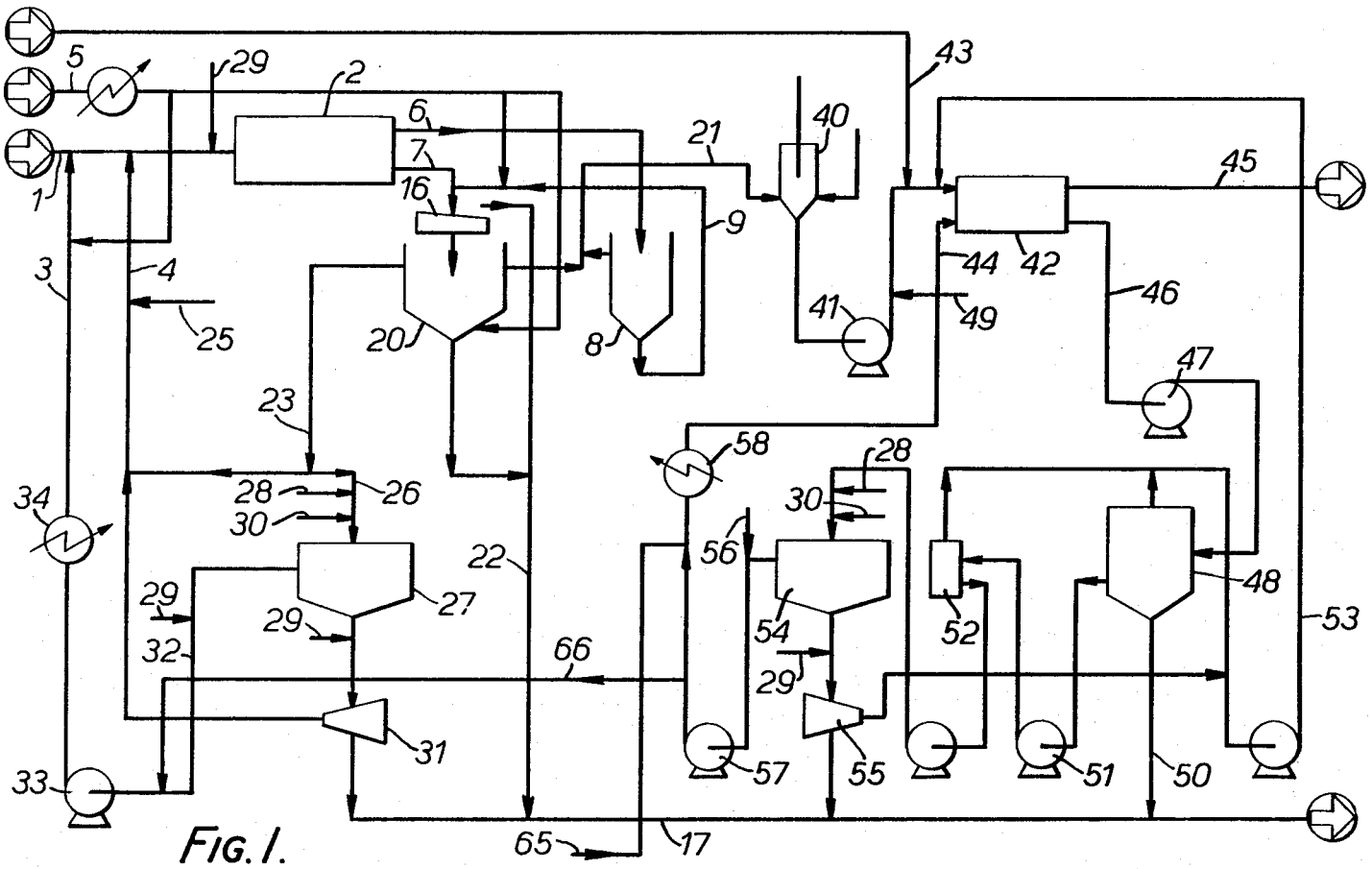
FIG. 1 is a flow diagram illustrating the process.

In the extraction process depicted in FIG. 1, the mined oil sands are fed continuously on line 1 to a conditioning drum or "digester" 2, where they are subject to a gentle conditioning with hot water supplied on lines 3 and 4 and make up water on line 5. The pH of the water is adjusted by addition of sodium hydroxide or other suitable reagent on line 29. In the digester 2, the oil sands are subject to gentle agitation, to liberate the bitumen oils, without disaggregation of the clay lumps which accompany the oil sands. Moreover, the high water to solid ratio and the moderate mechanical action developed inside the digester makes possible the formation inside the digester of two distinct and separate layers: one containing the majority of the water and oil and one containing the majority of the solids. The flow diagram of FIG. 1 takes advantage of that fact, the stream containing the majority of the solids and the liquid stream being discharged separately from the digester 2 on lines 7 and 6 respectively.

The temperature of the hot water supplied to the digester 2 is at least 70° C. and is preferably 90° C.

The treatment of the tar sands in the conditioning drum 2 is at high dilution, the ratio of water to oil sands being at least 1:1 by weight. Normally, a water to oil sands ratio of 1.5:1 is adopted, but if the amount of clay in the oil sands increases, a ratio of 2:1 is preferred. Where there are abnormally large amounts of large frozen lumps of tar sands in the feed, with a consequential requirement for a higher heat input, the ratio may be as large as 3:1.

The gentleness of the conditioning of the oil sands in the digester 2 and the relatively high hot water/oil sands ratio are predicated on theoretical considerations and on extensive laboratory studies, which have shown that oil sand is an unstable system above the softening point temperature of the bitumen; above the softening point temperature of the bitumen, the main energy source for the disaggregation of the oil sands is the interfacial energy between the connate water and the bitumen oils; clay lumps are much less sensitive to thermal action than to mechanical action for their disintegration; the oil sands can be digested with hot water without any steam injection; the connate water acts as a lubricant during the detachment of the bitumen oils; the presence of fractures in the oil sands lumps reduces the size of the aggregates and makes the action of hot water easier; and a gentle agitation of the oil sands/water mixture inside the drum is required to increase water-solids contact and heat transfer. Heavy mechanical disintegration of the mined oil sands in the digester is thus not only unnecessary, but is positively disadvantgeous in that it breaks up the clay lumps with the creation of relatively large amounts of fines in the resulting slurry. A gentle conditioning at high dilution on the other hand effectively releases the bitumen oils without the breaking up of the clay and the creation of large amounts of suspended fines. Furthermore, it has been found that the solids—the sand and clay—separate from the liquid components of the slurry in the digester 2.

From the digester 2, the coarse solids on line 7 pass through a screen 16 directly to a desander 20; screen 16 diverts oversize lumps (usually of clay, rock and other foreign matter) to the reject line 17. The liquid stream on line 6, on the other hand, is fed into an oil/water separator 8, in which air flotation may occur to aid separation; the lower water fraction withdrawn on line 9 is sent to dilute the coarse solids stream on line 7, prior to encountering the screen 16. It could be advantageous, in some cases, to subject the stream on line 9 to a scavenging treatment by air floatation, rather than have.that treatment performed in the oil/water separator 8.

The two stages of separation performed in desander 20 and oil/water separator 8 achieve a low bitumen oil concentration in the desander which, together with the positive effect on the gentle conditioning and high water dilution on the clays concentration, reduces the oil losses with the sand rejected from the bottom of desander 20 to line 17. Moreover, the low bitumen oil concentration in the middlings greatly improves the operability of the water treatment units to be described subsequently.

The bitumen froth recovered at the top of separator 8 and at the top of desander 20 is withdrawn and fed on line 21 to deaerator 40 for subsequent treatment to be described later. The reject sand is delivered on line 22 to the reject line 17, while the middlings layer is removed on line 23 and is recycled to the digester 2 after being treated for partial removal of solids.

The aqueous middlings on line 23 is pumped to recycle line 4, the temperature of the water being raised by steam injection on line 25. A bleed steam of the middlings is fed on line 26 to a thickener/flocculation unit 27, the middlings being dosed with acid on line 28 to lower the pH for flocculation created by the injection of flocculant on line 30. The thickened solids, which include coagulated fines, are directed from unit 27 to a centrifuge 31, the solids from which pass to the solids reject line 17. The liquid from unit 27 is discharged on line 32, is pumped by pump 33 to line 3, the temperature being raised by a heat exchanger 34 before being fed into the digester.

The liquid from centrifuge 31 is recycled to digester 2 via line 4. Depending upon operation conditions of the process the liquid on line 32 and the thickened solids from unit 27 may be partially or totally neutralised by the injection at 29 of sodium hydroxide or other suitable basic material. Alternatively a sequestering agent, such as sodium phosphate may be used.

Make up water on line 5, after its temperature has been raised by a heat exchanger is fed either to line 3 or line 9. Make up water may also be added from line 5 to the bottom of desander 20 as shown.

Because of the lack of disintegration of the clay lumps in the digester 2, the amount of fines for removal by the thickening unit 27 and the centrifuge 31 is relatively small, with the consequence that the capacity of the equipment is small and the amounts of acid, flocculant and neutraliser to be injected are also small. Further the amount of flocculant to be injected on line 30 is directly dependent on the amount of hydrocarbons in the middlings stream and because of the effectiveness of the oil removal in units 8 and 20 there is again a saving of flocculant.

The oil-rich froth withdrawn from the desander 20 and from the oil/water separator 8 on line 21 is fed through the deaerator 40 to a pump 41 which pumps the froth to a contactor 42, diluent being previously supplied on line 43 to dissolve the bitumen oils. To the bitumen froth emulsion breaking chemicals are added, e.g. on line 49, to enhance the efficiency of the subsequent water removal process. As described in Canadian Patent Application No. 366105 the solution of the bitumen oils is washed with a stream of water supplied on line 44 in order to remove water and solids contained in the froth. While the diluted froth and the water stream are shown as passing co-currently through contactor 42, the contactor may be operated counter-currently.

The emulsion breaking chemical, instead of being injected on line 49, may be introduced into the contactor 42, preferably at a number of spaced points along the contactor. The de-emulsifier causes coalescence of small water droplets mixed with the hydrocarbon phase in the contactor and avoids the difficulty of settling those droplets out of the bitumen oils.

The bitumen oils solution is discharged from the contactor on line 45, while the water stream discharge on line 46 is treated for removal of contained solids and oil diluent.

The water stream on line 46 is pumped by pump 47 to a coarse solids separator 48, which is similar to the desander 20. The coarse solids—included sand—are discharged from separator 48 on line 50 to the reject solids line 17, while the aqueous middlings are pumped by pump 51 to an oil/water separator 52. The separated oil from separators 48 and 52 is pumped on line 53 to the diluted oils input to contactor 42.

The water phase from the oil/water separator 52 is pumped to a thickener/flocculation unit 54 after pH adjustment, the thickened solids from which are passed to centrifuge 55; units 54 and 55 are similar in construction and function to the unit 27 and centrifuge 31, the liquid discharged from centrifuge 55 being fed to line 53 for recycle. The liquid from the thickener unit 54, after neutralisation if necessary by injection of caustic on line 56, is recycled by pump 57. The bulk of the recycled water is heated by heat exchanger 58 to form the water stream on line 44, while the remainder is recycled to the digester by being fed on line 66 to the pump 33 and the water line 3.

Because the bulk of the oil is removed by separator 52 from the middlings stream from the solids separator 48, and because of the relatively small amounts of fines in the system, the operation of the thickener 54 is eased and the centrifuge 55 need be of small capacity; as before the use of acid, flocculant and caustic is similarly reduced. It has been found that cleaner water and thicker solid sludge can be obtained if the pH of the thickener underflow is adjusted, as shown, before it is sent to the centrifuge 55, exactly as in the case of the thickening unit 27 and centrifuge 31.

Since the recycling of water from thickener 54 to the water feed line 44 of contactor 42, with unavoidable minor quantities of solids, may detract from the efficiency of the contactor, the water feed line 44 of the contactor may be supplied with fresh make up water on line 65 as shown in FIG. 1. In that case, all the water from thickener 54 is pumped by pump 57 and line 66 to the recycle line 14.

Figure 2:
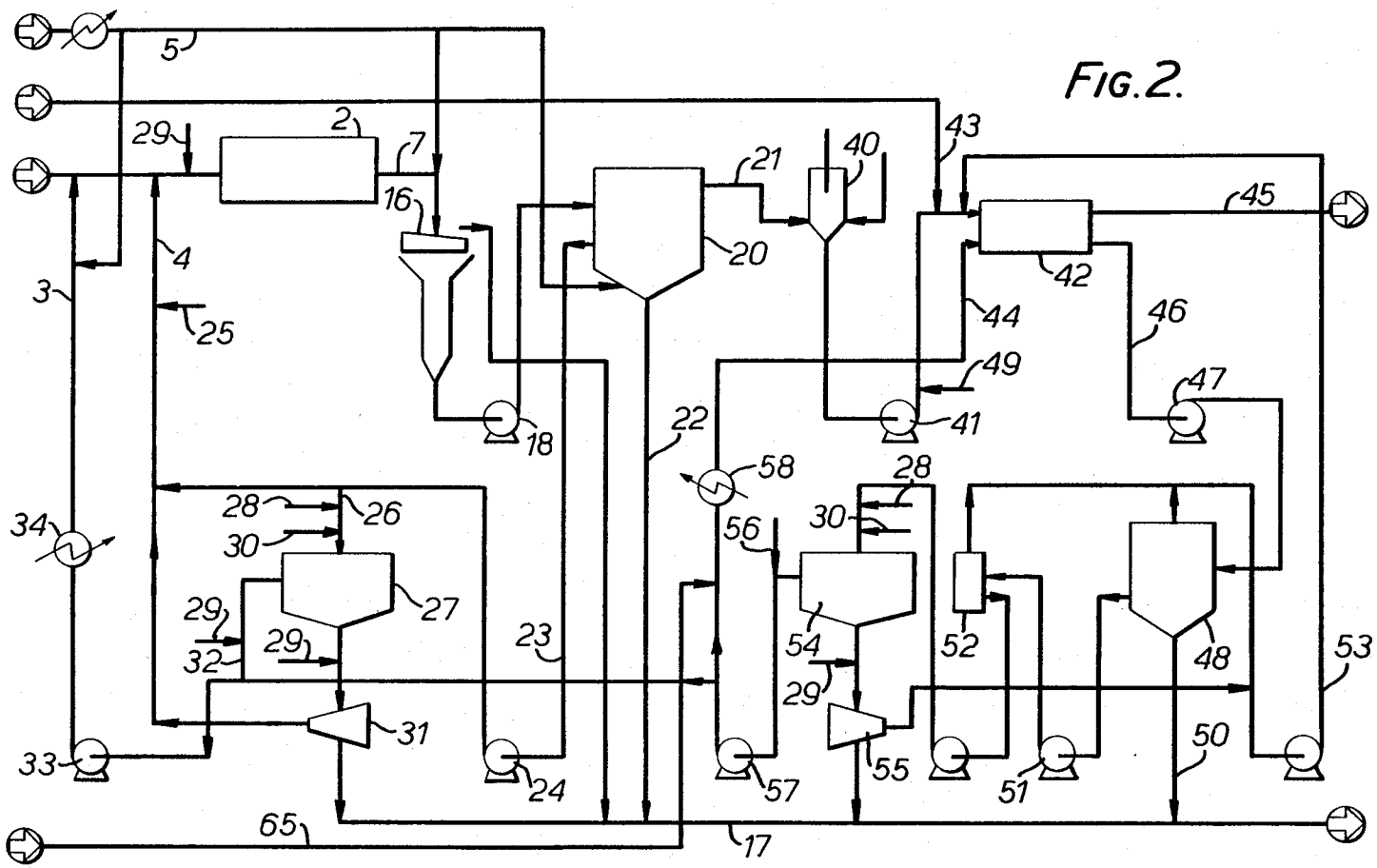
FIG. 2 shows a modification of the process of FIG. 1.

FIG. 2 shows a simplified version of the flow diagram of FIG. 1 where the separation of the bituminous froth, the middlings and the coarse solids occur in a single vessel-the desander 20. The rest of the flow diagram remains unchanged.

A conditioner or digester suitable for use as the digester 2 of FIG. 1 and having separate outlets is described and illustrated in British patent application No. 8023230. For convenience, the digester of that application is shown in the accompanying FIGS. 3 to 6.

The conditioning drum or digester is constituted by a rotary drum having a shell 100, mounted on rollers for rotation about a horizontal axis and driven through a gearth gear (not shown).

Figure 4:
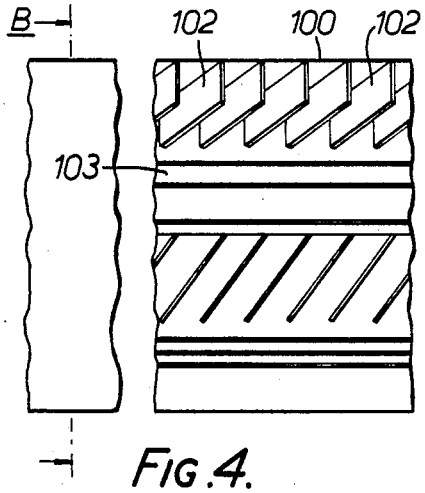
FIGS. 4 and 5 are sections on the lines A—A of FIG. 3, the internal screwbars being omitted at the upper part of FIG. 4, and only those screw bars being shown in FIG. 5.
Figure 5:
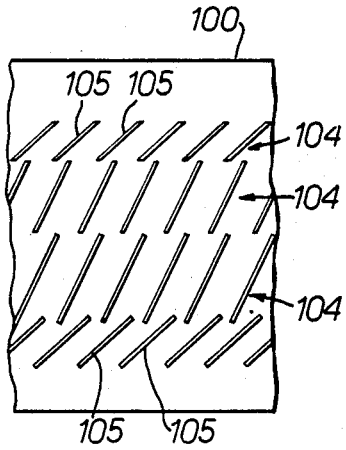

Secured to the internal wall of the shell 100, and extending over the larger part of the length of the drum from one end, there are a number of circumferentially spaced screw sections 101; in the example illustrated, there are four such sections. Each section consists of a series of axially spaced flat bars 102, which are parallel and inclined to a plane at right angles to the axis of the drum, as shown in FIG. 4. The bars 102 extend from the shell 100 only a short distance, compared with the drum diameter.

Between consecutive pairs of screw sections 101 are assemblies of stirrers 103. Each stirrer is a flat bar, which is secured to the internal wall of the shell 100, and which extends parallel to the shell axis; as will be seen in FIG. 3, the stirrers 103 are not radially disposed, but each is inclined to the respective radius.

The digester also has sets 104 of internal screw bars 105, eight such sets being illustrated in the drawing with one set aligned with each of the screw sections 101 and each assembly of stirrers 103. Each screw bar 105 is rod like, although preferably it has a square section, and is secured at one end to the extremities of the flat bars 102. Further, as will be apparent from FIGS. 4 and 5, the internal screw bars 105 in each set are inclined to the drum axis in herring-bone style, while the bars of each set 104 are offset from those of the adjacent set.

Figure 6:
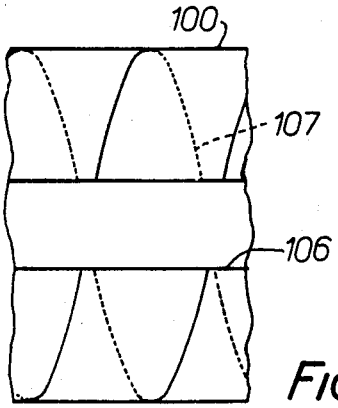
FIG. 6 is an axial section of the axial end of the conditioning unit.

One end of the shell 100 is closed by an end plate, having a central inlet for entry of feed material. The other end, illustrated in FIG. 6, is open and has a central tubular solids outlet 106, which extends beyond the end of the shell 100 and over a short axial length of the shell. The tubular solids outlet 106 is secured in place by a screw 107, the outer periphery of which is welded or otherwise secured to the interior wall of the drum 100. The annular passage which surrounds the outlet 106 and which contains the screw 107 constitutes a solids outlet.

Figure 3:
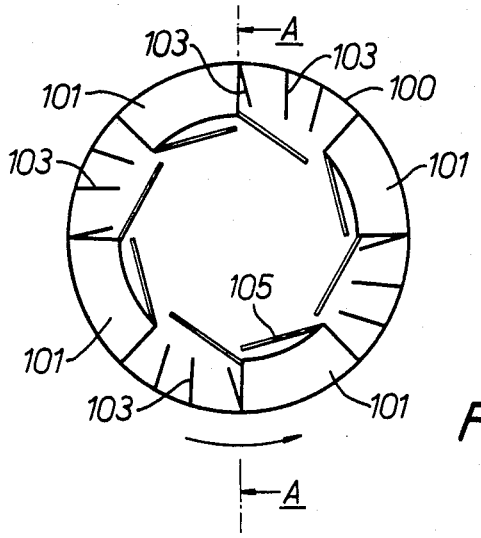
FIG. 3 is a radial section through the conditioning unit of FIG. 1.

The oil sands slurry on line 1 is introduced into the digester drum through the inlet. The drum is rotated in anti-clockwise direction as seen in FIG. 3 at a low rate of, for example, a few revolutions per minute, the slow speed being chosen to avoid break-up of the clay lumps. The slurry enters the central space within the internal screw bars 105; those screw bars have a spacing such that the relatively small masses of oil sands, and the solids from disintegrated oil sands, to fall through the screw bars into the annular space between them and the shell 100. On the other hand, large masses of clay are prevented from entering that space and, initially, are moved progressively along the digester, by the screw action of the bars 105.

The oil sands and solids that have fallen through the internal screw bars 105 are gently agitated by the stirrers 103 which, because of their inclination, do not carry the solids far up the digester during rotation of the shell. At the same time, the solids are moved progressively axially along the shell 100, by the action of the sections 101 of flat bars 102.

By the gentle agitation of the oil sands by the stirrers 103, the particles of oil sands are broken up releasing the bitumen oils into the hot water, while the remaining sand is retained between the internal screw bars 105 and the shell 100. Towards the discharge end of the shell 100, the spacing of the internal screw bars 105 is increased, thus allowing the clay masses to fall through them to join the now oil-free sands. The inclination and spacing of the flat bars 102 are such that the solids move axially along the shell at a speed which is substantially less than the throughput of liquids.

At the discharge end of the drum, the liquids—the hot water and the bitumen oils from the oil sands—are discharged through the central tubular outlet 106 to line 6 (FIG. 1). At the same time, the solids, which are progressed along the bottom of the drum by the screw action of the flat bars 104, are discharged by the screw 107 through the solids outlet surrounding the liquids outlet 106 and to the line 7.

We claim:

1. A process for extracting bitumen oils from a raw material consisting essentially of oil sands and lumps of disintegrable material such as clay, the process including the steps of (a) conditioning the raw material in a conditioner by introducing a stream of hot water with a water to raw material ratio of at least 1:1 by weight and by gently mixing the water and raw material without sufficient force to cause substantial disintegration of clay present in the raw material while promoting the release of bitumuen oils from the solids of said raw materials and forming within the conditioner of separate solids and liquid phases;

(b) moving said solids along said conditioner without maintaining them in suspension and discharging said solids phase from said conditioner separately from said liquid phase;

(c) separating said liquid phase into an oil-rich component and a middlings component containing essentially water and fines and with only minor proportions of oil and solids;

(d) removing at least a part of the fines from said middlings component by flocculation separation of said middlings component and contrifuging of the produced thickened solids, and thereby producing a fines discharge of relatively low liquid content and a liquid discharge;

(e) immediately recycling said liquid discharge while hot as at least a part of the hot water supplied for said conditioning; and (f) delivering said oil-rich component for further treatment.

2. A process according to claim 1, in which the liquid phase is separated into a bitumen froth and a separated water portion, and said water portion is used to dilute the solids phase from said conditioner and is subjected to a liquids/solids separation.

3. A process according to claim 1, in which the temperature of the hot water is at least 70° C.

4. A process according to claim 1, in which the temperature of the hot water is about 90° C.

5. A process according to claim 1, in which the middlings component after centrifuging and before being used for conditioning is neutralised.

6. A process according to claim 1, in which only a part of the recycled middlings component is treated for removal of fines and solids, the remainder being recycled directly to said conditioner.

7. A process according to claim 1, in which the oil-rich component is separately treated for the removal of contained water, fines and solids.

8. A process according to claim 7, in which the oil-rich component is treated with a diluent to dissolve the oil and washed with a stream of water, which is recycled after being treated separately for removal of fines and solids.

9. A process according to claim 8, in which the stream of water after contacting the diluted oil-rich component is passed successively to a separator for removing coarse solids, and oil/water separator, and a unit for removing fines.

10. A process according to claim 9, in which the unit for removing fines comprises a flocculator and a centrifuge.

11. A process for extracting bitumen oils from a raw material consisting essentially of oil sands and disintegrable material such as clay, the process including the steps of (a) conditioning the raw material in a conditioner by introducing a stream of hot water with a water to raw material ratio of at least 1:1 by weight and by gently mixing the water and raw material without sufficient force to cause substantial disintegration of clay present in the raw material while promoting the release of bitumen oils from the solids of said raw material and forming within the conditioner of separate solids and liquid phases;

(b) moving said solids along said conditioner without maintaining them in suspension and discharging said solids phase from said conditioner separately from said liquid phase;

(c) separating said liquid phase into an oil-rich component and a middlings component containing essentially water and fines and with only minor proportions of oil and solids;

(d) removing at least a part of the fines from said middlings component by flocculation separation of said middlings component, preceded by pH adjustment, and centrifuging of at least a part of the produced thickened solids, and thereby producing a fines discharge of relatively low liquid content and liquid discharge;

(e) immediately recycling said liquid discharge while hot as at least a part of the hot water supplied for said conditioning; and (f) delivering said oil-rich component for further treatment.

12. A process according to claim 11 in which the flocculated middlings component is thickened in a thickener to produce a thickened stream comprising said thickened solids and a less dense stream, said thickened stream being centrifuged to separate said fines discharge from said liquid discharge and the centrifuged liquid discharge and the less dense stream from the thickener being recycled to the conditioning stage.

* * * * *